United States Patent [19]

Richards

[11] 4,249,762

[45] Feb. 10, 1981

[54] ATHLETIC CLUB SWING TRAINING DEVICE

[76] Inventor: M. David Richards, 1595 N. Berenice Dr., Brea, Calif. 92621

[21] Appl. No.: 28,061

[22] Filed: Apr. 9, 1979

[51] Int. Cl.[3] ..... A63B 69/36

[52] U.S. Cl. ..... 273/193 A; 272/124

[58] Field of Search ..... 272/124, 117, 143, 122, 272/67, 26 B, 29 A; 273/193 R, 193 A

[56] References Cited

U.S. PATENT DOCUMENTS

| | | | |
|---|---|---|---|
| 1,930,342 | 10/1933 | Graham | 273/193 A |
| 3,351,346 | 11/1967 | Strahan | 273/193 A |
| 3,414,260 | 12/1968 | Gust | 272/124 |
| 3,874,660 | 4/1975 | Brethen | 272/124 |

*Primary Examiner*—George J. Marlo

*Attorney, Agent, or Firm*—Francis X. LoJacono

[57] ABSTRACT

A wrist-exercising device that is held in the hand, or hands, of the user while he swings the device as one would a tennis racket, a golf club, or a baseball bat, wherein the device comprises an elongated shaft defined by a handle formed on the free end of the shaft, and including at the opposite end thereof an adjustable coupling member to which is mounted the exerciser arm, the arm being connected to the coupling member so as to be positioned in any predetermined angular degree relative to the handle thereof, wherein the radially extended arm is provided with an interchangeable weight member.

The coupling member includes a body member having a locking-block member supported thereon, with a journal member rotatably mounted to the locking-block member. A threaded pin is secured to one end of the arm and passes through the journal, the locking block, and the body member, whereby the pin is provided with a knob to lock the arm in a suitable position. A securing bolt is supported in the body member and extends into the shaft for engagement with a neck member and a cam-head member, thus locking the coupling member to the shaft. A second coupling member includes a first and a second jaw member, each having a plurality of teeth which are adjustably held together by a pin and nut arrangement.

2 Claims, 8 Drawing Figures

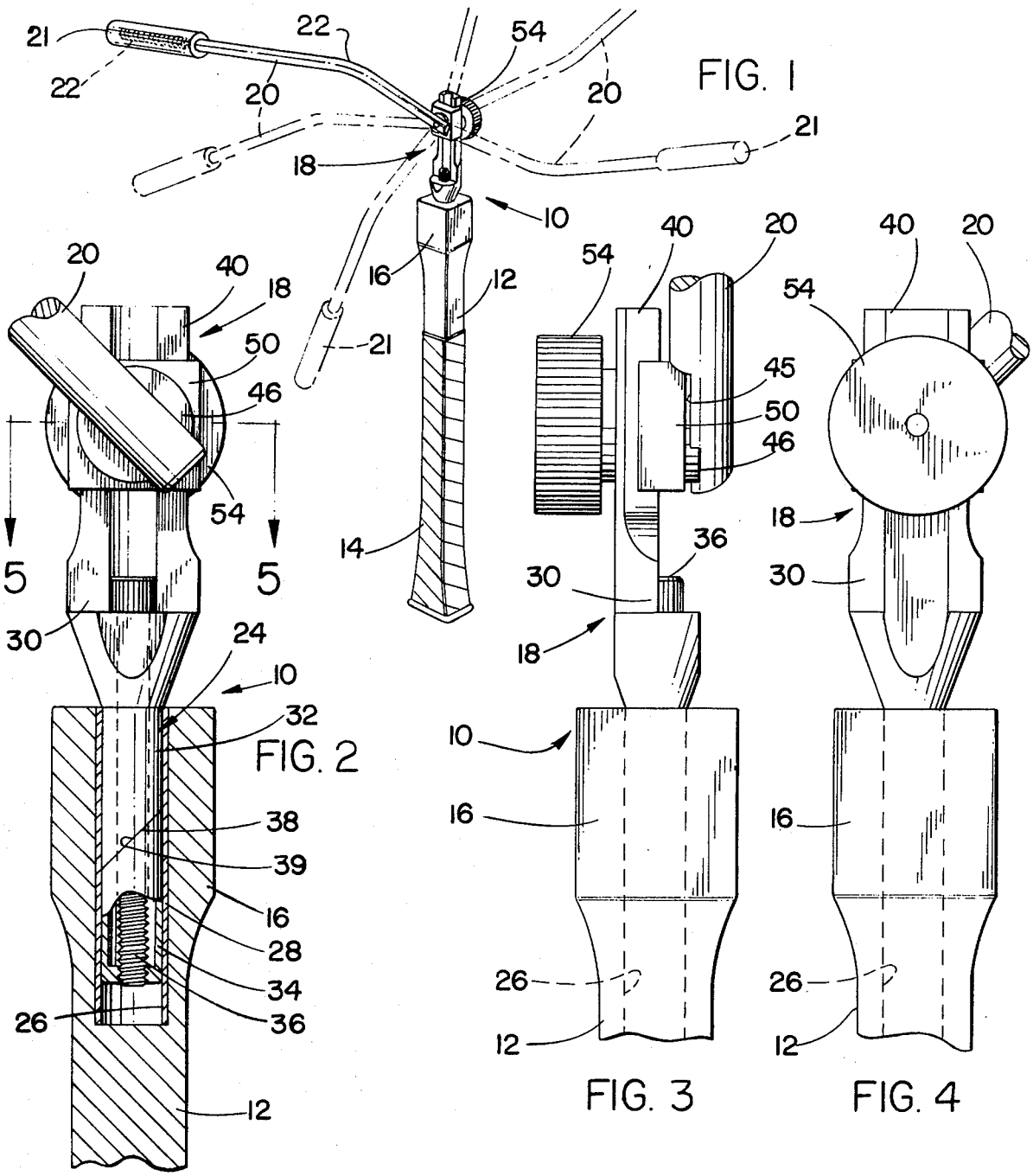
FIG. 1
FIG. 2
FIG. 3
FIG. 4
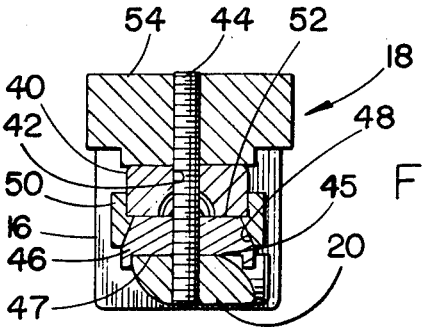
FIG. 5

20
45
44
40
54
52
46
47
48
50
30
18
21
20
18
12

21
20
18
60
64
44a
18b
62
18a
12

32
38
39
36
34

ATHLETIC CLUB SWING TRAINING DEVICE

BACKGROUND OF THE INVENTION

1. Field of the Invention

This invention relates generally to an exercising device, and more particularly to an exercising device designed to improve and strengthen the wrist and arm muscles.

2. Description of the Prior Art

As is well known in the art of body-building equipment, various problems and difficulties have been encountered in providing a suitable yet simple device for excercising the wrist and arm muscles so as to enable individuals not only to lose weight but to aid them in related sporting games. As an example, for a long time there has been a need for a device that would provide a tennis player with a means to develop better muscle control in swinging a racket, and wherein the wrist action and arm action can be practiced with an exercising device when one is not playing the game. This is also applied to golfers and to baseball players.

SUMMARY OF THE INVENTION

Accordingly, it is an important object to provide an excercising device that is capable of being used by any individual who would like to improve his swing relating to the different types of sports wherein the wrist, arm and shoulder muscles play an important part in the playing of the game. In tennis, racket ball, baseball and golf one must develop a swing action. Therefore, the present invention provides a means to exercise the related muscles while using the device in a similar action as required in the above-mentioned sports.

The present device comprises a shaft member having a handle end and an adjustable coupling joint affixed to the opposite end thereof. Rotatably mounted to the coupling joint is a weighted arm member which extends radially outward therefrom. The arm member is adjustable so as to be positioned at various angles relative to the handle. By changing the angle of the weighted arm, different stresses can be applied to the swinging motion of one's arm or wrist. Thus, the device can be adjusted to the various exercising requirements and to an individual's own needs.

it is another object of the invention to provide an exercising device of this character that has relatively few operating parts.

It is still another object of the invention to provide an exercising device of this type that uncludes interchangeable weight-control units.

It is a further object of the invention to provide a wrist-exercising device that is relatively inexpensive to manufacture, and that is simple and rugged in construction.

The characteristics and advantages of the invention are further sufficiently referred to in connection with the accompanying drawings, which represent one embodiment. After considering this example, skilled persons will understand that variations may be made without departing from the principles disclosed; and I contemplate the employment of any structures, arrangements or modes of operation that are properly within the scope of the appended claims.

BRIEF DESCRIPTION OF THE DRAWINGS

Referring more particularly to the accompanying drawings, which are for illustrative purposes only:

FIG. 1 is a pictorial view of the present invention, showing various angular positions of the weighted arm member relative to the handle;

FIG. 2 is a fragmented sectional view of the upper portion of the handle, illustrating the adjustable coupling means;

FIG. 3 is a side-elevational view thereof;

FIG. 4 is a front-elevational view thereof;

FIG. 5 is a cross-sectional view taken along line 5—5 of FIG. 2;

DESCRIPTION OF THE PREFERRED EMBODIMENT

Figures 6, 7, 8:
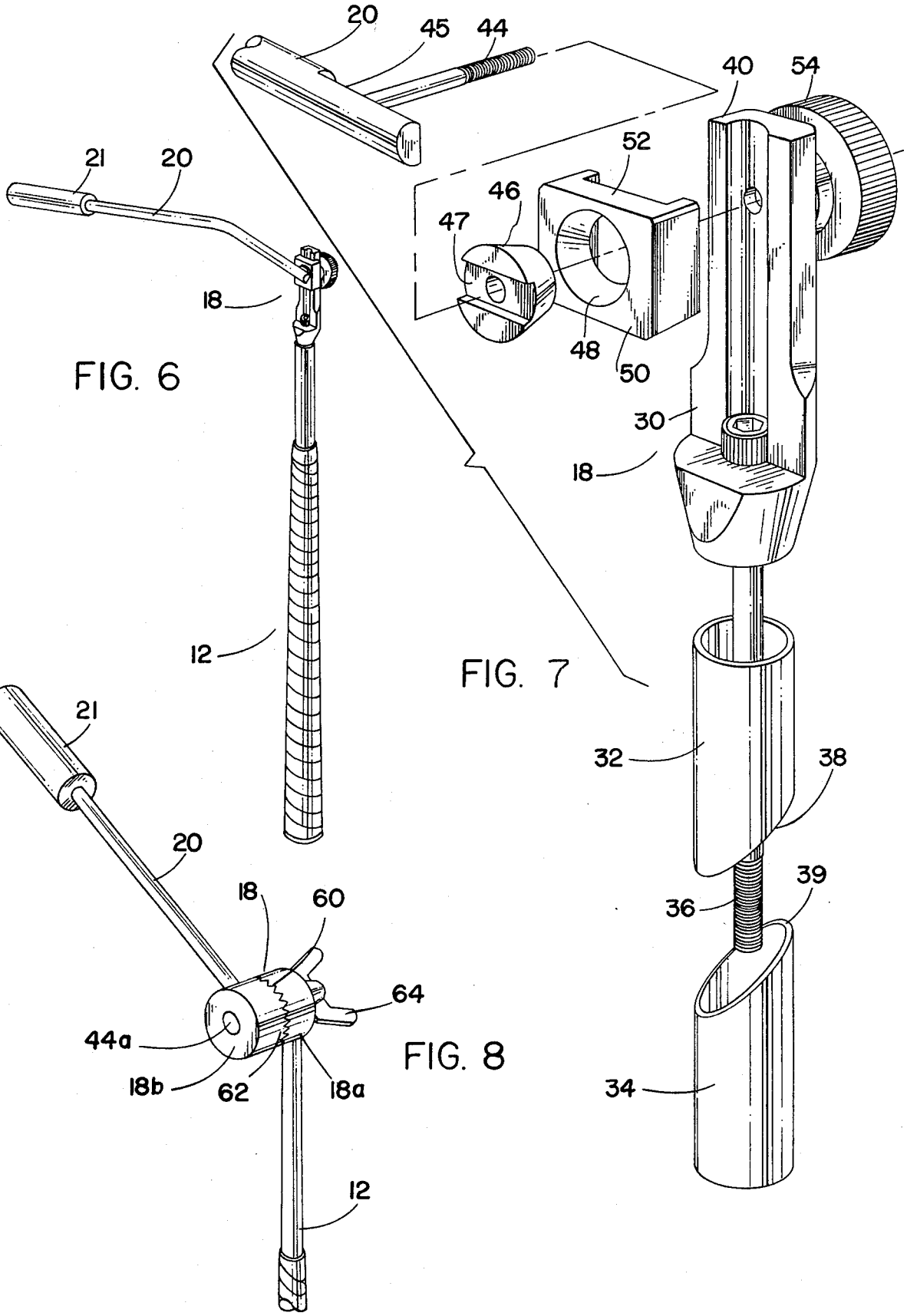
FIG. 6 is a perspective view of an alternative arrangement of the invention.
FIG. 7 is an exploded perspective view of the coupling means.
FIG. 8 is an alternative arrangement of a coupling means.

Referring more particularly to FIG. 1, there is shown an exercising device, generally indicated at 10, which is designed to be held in either or both hands of an individual so as to exercise the wrist and/or arm. The exercising device comprises an elongated shaft 12 which includes a lower portion defining a handle or grip 14, and wherein the upper portion or end of the shaft is provided with a head 16 which is adapted to lockably receive a coupling-joint means, generally indicated at 18.

Adjustably affixed to the couping-joint means 18 is an elongated, radially-extended, weighted arm member 20 having removably mounted to the outer free end thereof a weight 21 which can be provided in different sizes for different weights, the weight being internally threaded to the threaded end 22 of arm 20. Arm 20 as seen in FIG. 1 is also provided with a slight bend, as at 22. This off-set position allows variations as to the swing reaction of the device with respect to the angular setting of the arm and weight to that of the handle 14. Thus, arm 20 can be adjusted to the swing of a tennis player, golfer, etc.

Accordingly, the angular adjustment is provided by the coupling-joint means 18 which includes an adjustable securing means, indicated generally at 24, adapted to be fixedly mounted to head 16 of shaft 12, as seen in the cross-sectional view of FIG. 2 wherein head 16 is formed having a bore 26 in which sleeve 28 is fixedly secured therein. The coupling-joint means 18 comprises a main-body member 30 having an adjustable securing means positioned adjacent the lower end thereof, the securing means being formed by an extended neck member 32 having the same approximathe outer diameter as the inner diameter of sleeve 28. Neck member 32 includes a free-end cam head 34 which is held in place by an elongated bolt 36, which extends through neck member 32 and is threadably received within cam head 34. The adjoining or abutting inner faces 38 and 39 of respective members 32 and 34 are angularly disposed to each other so as to split and bind within sleeve 28 as bolt 36 is tightened. This binding action locks the coupling joint in place with respect to the handle. Thus, once this is accomplished, weighted arm 20 can be angularly positioned by adjusting the coupling means; and body member 30 further includes a mounting post 40 having a hole through which passes a threaded pin 44, the pin being affixed to the connecting end of arm 20 as seen in FIG. 5. Arm 20 is provided with a flat shoulder 45 adapted to engage a truncated journal member 46 which is provided with a flat channel 47 to engage the flat shoulder 45 of the arm 20. The conical shape of journal 46 is arranged to fit within a similar-shaped bore 48 formed in a locking-block member 50. This allows journal member 46 to rotate within locking block 50. Locking block 50 is held stationary because it is provided with a groove 52 that receives post 40 therein.

When the angular position of arm 20 and weight 21 is selected, knob 54 is tightened on pin 44—whereby arm 20, journal 46, and locking block 50 are secured to post 40 of the main body 30. Thus, it can be understood that—when knob 54 is not tightened against post 40—journal 46 is freed and weighted arm 20 can be rotated about the axis of pin 44 and journal 46, and then secured at any point along the 360° axis thereof.

FIG. 6 illustrates the exercising device as having a shaft 12 with a design of that often used in forming a golf club, shaft 12 being defined with an internal bore to fixedly receive coupling means 18.

Referring now to FIG. 8, there is shown an alternative arrangement of a coupling-joint means 18 comprising a first jaw member 18*a* and a second jaw member 18*b*, the first jaw member 18*a* being affixed to shaft 12 and having a plurality of radially disposed teeth 60 on the inner face thereof, and the second jaw member being affixed to arm 20 and also having matching teeth 62 on its inner face so as to engage in locking contact with the opposing teeth 60. Secured to jaw member 18*b* is a threaded pin 44*a* which passes through jaw 18*a* on which is received wing nut 64, whereby the jaws are held in place to lock arm 20 and weight 21 in a predetermined position.

The invention and its attendant advantages will be understood from the foregoing description, and it will be apparent that various changes may be made in the form, construction and arrangement of the parts of the invention without departing from the spirit and scope thereof or sacrificing its material advantages, the arrangement herein before described being merely by way of example, and I do not wish to be restricted to the specific form shown or uses mentioned, except as defined in the accompanying claims.

I claim:

1. An exercising device adapted to be held in one's hand and used in a swing motion, said device comprising:

an elongated shaft wherein one end thereof is defined as a handle;

an elongated arm member having a free end and a fixed end rotatably coupled to said shaft;

a weight member removably secured to said free end of said shaft; and coupling-joint means interconnecting said arm to said shaft, whereby said arm is radially adjustable with respect to said handle;

securing means between said coupling-joint means and said shaft, whereby said coupling-joint means is secured to said shaft in a predetermined position;

wherein said coupling-joint means comprises:

a body member having said securing means adjustably mounted thereto;

a locking-block member supported on said body member, and having an opening formed therein;

a journal member adapted to be rotatably mounted to said locking-block member;

a threaded pin secured to one end of said arm and adapted to pass through said journal, said locking block, and said body member; and a knob threadably engageable with said pin to lock said arm in any suitable angular position.

2. An exercising device as recited in claim 1, wherein said securing means comprises:

a longitudinal bolt member supported in said body member and extending downwardly from one end thereof;

a neck member having an angular abutting end wherein said bolt passes therethrough;

a cam-head member having an angular abutting end to engage the abutting end of said neck member and to provide a locking engagement within said shaft, and wherein said cam head is attached to said bolt member.

* * * * *